US007503940B2

(12) United States Patent
Donaldson et al.

(10) Patent No.: US 7,503,940 B2
(45) Date of Patent: Mar. 17, 2009

(54) METHOD AND SYSTEM FOR SPOT-DYEING TEXTILES

(75) Inventors: Craig Donaldson, Logan, UT (US); Edward E. Durrant, Providence, UT (US)

(73) Assignee: Harris Research, Inc., Logan, UT (US)

( * ) Notice: Subject to any disclaimer, the term of this patent is extended or adjusted under 35 U.S.C. 154(b) by 0 days.

(21) Appl. No.: 10/778,858

(22) Filed: Feb. 13, 2004

(65) Prior Publication Data

US 2004/0177452 A1 Sep. 16, 2004

Related U.S. Application Data

(60) Provisional application No. 60/448,989, filed on Feb. 20, 2003, provisional application No. 60/476,752, filed on Jun. 6, 2003.

(51) Int. Cl.
*D06P 5/00* (2006.01)

(52) U.S. Cl. ..... 8/441; 8/478; 8/485; 8/486; 8/504; 8/527; 8/528; 8/636; 8/929; 8/930

(58) Field of Classification Search ..... 8/441, 8/478, 485, 486, 504, 527, 528, 636, 929, 8/930

See application file for complete search history.

(56) References Cited

U.S. PATENT DOCUMENTS

| | | | | |
|---|---|---|---|---|
| 3,682,582 A | | 8/1972 | Monsanto | 8/18 |
| 4,782,672 A | | 11/1988 | Secolo | 68/205 R |
| 4,803,746 A | | 2/1989 | Bryant | 8/151 |
| 4,834,900 A | | 5/1989 | Soldanski et al. | |
| 5,085,795 A | | 2/1992 | Narayanan et al. | 252/162 |
| 5,116,243 A | | 5/1992 | Wills | 8/149.2 |
| 5,235,358 A | * | 8/1993 | Mutzhas et al. | 351/163 |
| 5,255,350 A | * | 10/1993 | Hermann et al. | 358/1.9 |
| 5,259,848 A | | 11/1993 | Terry et al. | 8/111 |
| 5,272,518 A | * | 12/1993 | Vincent | 356/405 |
| 5,786,317 A | | 7/1998 | Townsend | 510/278 |
| 6,028,044 A | | 2/2000 | Harris | 510/280 |
| 6,102,972 A | | 8/2000 | Durrant | 8/137 |
| 6,187,738 B1 | | 2/2001 | Micciche et al. | 510/278 |
| 6,533,824 B1 | * | 3/2003 | Roper | 8/441 |

FOREIGN PATENT DOCUMENTS

| | | |
|---|---|---|
| WO | WO 8912136 A1 | 12/1989 |
| WO | WO 9630474 A1 | 10/1996 |
| WO | WO 0026329 A1 | 5/2000 |

* cited by examiner

*Primary Examiner*—Lorna M Douyon
*Assistant Examiner*—Tri V Nguyen
(74) *Attorney, Agent, or Firm*—Keely Schneiter, P.C.

(57) ABSTRACT

Methods for spot-dyeing a damaged area on a textile employing a selected color loss filter and utilizing at least one of a primary color dye. In one embodiment, the method can include the following: inspecting the damaged area through the selected color loss filter; determining whether a primary color is missing from the damaged area by being able to view the damaged area through the selected color loss filter to, thereby, confirm that the primary color is missing from the damaged area; and applying at least one of a primary color dye, corresponding to the selected color loss filter, to the damaged area, while viewing the damaged area through the color loss filter, until the damaged area is substantially invisible through the color loss filter.

13 Claims, 1 Drawing Sheet

METHOD AND SYSTEM FOR SPOT-DYEING TEXTILES

CROSS-REFERENCES TO RELATED APPLICATIONS

This application claims priority to U.S. Provisional Patent Application No 60/448,989 entitled "A Method Of Spot-Dyeing Textiles" and filed on Feb. 20, 2003 for Craig Donaldson and Edward E. Durrant, which is incorporated herein by reference. This application also claims priority to U.S. Provisional Patent Application No. 60/476,752 entitled "Method of spot-dyeing textiles and Such" and filed on Jun. 6, 2003 for Craig Donaldson and Edward E. Durrant, which is incorporated herein by reference.

BACKGROUND OF THE INVENTION

1. The Field of the Invention

The invention relates to a method and system for spot-dyeing textiles. Specifically, the present illustrated embodiment(s) involve(s) the use of textile dyes, representing each of the three primary colors, color filters designed to transmit a narrow range of light corresponding to the three primary colors to facilitate matching the textile colors, and comparator gray scale cards to facilitate the determination of correct dilution levels of dye concentrates.

2. The Relevant Art

Many cleaning agents or products are damaging to dyes used in coloring textiles, such as carpet. When these damaging compounds come into contact with carpet, the carpet dyes will fade or completely discolor. A common cleaning product that is known to damage carpet dyes is an aqueous solution of hypochlorite, commonly known as chlorine bleach. Acne medication, containing benzoyl peroxide, is also known to cause damage to carpet dyes upon contact.

As a result, several carpet-cleaning services have developed spot-dyeing kits to re-color damaged areas or spots. Typically, these re-coloring dyes are added together in a solution until a color match is achieved. One particular kit provides more than a dozen different dye colors that can be added together in any sequence and amount to try and match the missing color on the carpet. This process is often extremely difficult because matching a solution color to the carpet color is not a process easily performed with the naked eye. Often, the re-coloring dyes look slightly different in solution than on a solid substrate, such as when applied to carpet fibers. To help overcome this, an uncolored piece of test carpet can be utilized. Dying this uncolored test carpet with the dye solution can help one discern what the dye solution will look like on a carpet fiber.

There are, however, still other problems associated with the process described above. Often, when the bleaching agent attacks a carpet dye, it will bleach the dyes most susceptible to bleaching. Some dyes in the carpet are not susceptible to bleaching and will remain unbleached. This means that a bleach spot on a carpet may leave the spot yellow or red or green or any other color other than colorless (white). In this case, trying to match the color on a colorless piece of carpet may be difficult, at best.

Other known carpet spot-dying procedures include the use of adding primary colors in sequence to a spot under naked eye inspection until a match is achieved. However, this method also involves a large amount of guesswork and/or trial and error in order to formulate a relatively close match. As a result, this method can be very time consuming and may also require re-bleaching a stained area for re-coloring where a mistake in judging the proper addition of colors has occurred.

Thus, it can be clearly recognized that there is a need for a method and system for spot-dyeing textiles, such as carpet, clothing, leather, or any other textile, that is easy to apply for any user, that reduces the amount of time required to achieve a color match, and that increases the accuracy of achieving a match while minimizing the margin of error.

SUMMARY OF THE INVENTION

The various elements of the present invention have been developed in response to the present state of the art, and in particular, in response to the problems and needs in the art that have not yet been fully solved by currently available methods of spot-dying textiles. Accordingly, the present invention provides an improved method for using textile dyes, representing each of the three primary colors, color filters designed to transmit a narrow range of light corresponding to the three primary colors to facilitate matching the textile colors, and gray scale comparator cards to determine working dye solutions.

More particularly, the present embodiments involve the use of three separate light filters for aiding an applicator's ability to accurately match a textile color. These filters include a blue loss filter, a red loss filter, and a yellow loss filter. Visible spots seen through the blue loss filter indicate a blue loss in the damaged area. While applying blue dye to a damaged area, the applicator looks through the blue loss filter so that only a narrow band of light wavelengths may be seen. The working blue dye solution is applied until all visible spots are made invisible through the filter. The process is repeated for red and yellow dyes, utilizing their respective filters, until a near perfect color match is achieved.

In another embodiment an applicator utilizes each of the loss filters to view the contrast between a white material and an undamaged area of a textile. The applicator compares a gray scale comparator card to the contrast between the white material and the undamaged area of textile to determine a correct concentration of working dye solution.

Additional features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments thereof, which are illustrated in the appended drawing. Understanding that this drawing depicts only one typical embodiment of the invention and is not therefore to be considered to be limiting of its scope, the invention will be described and explained with additional specificity and detail through the use of the accompanying drawing in which.

DETAILED DESCRIPTION OF THE INVENTION

Figure 1:
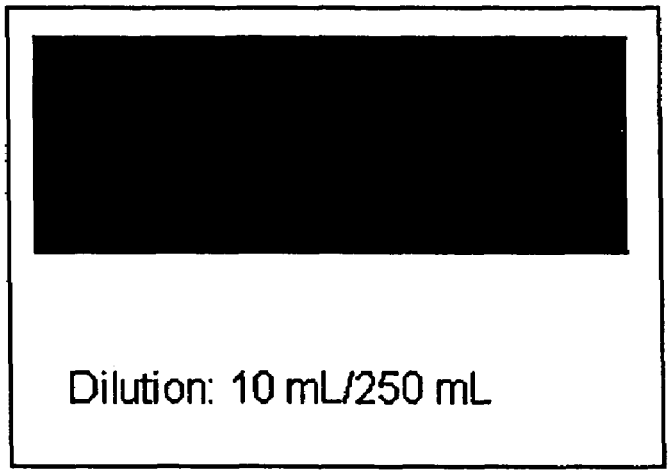
FIG. 1 illustrates one embodiment of the gray scale comparator cards.
Figure 1:
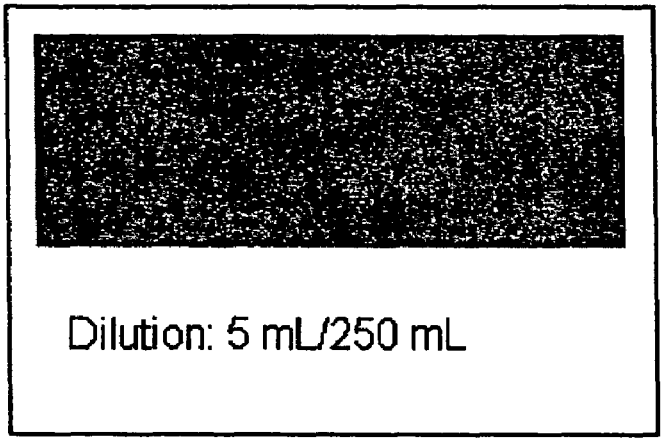
Figure 1:
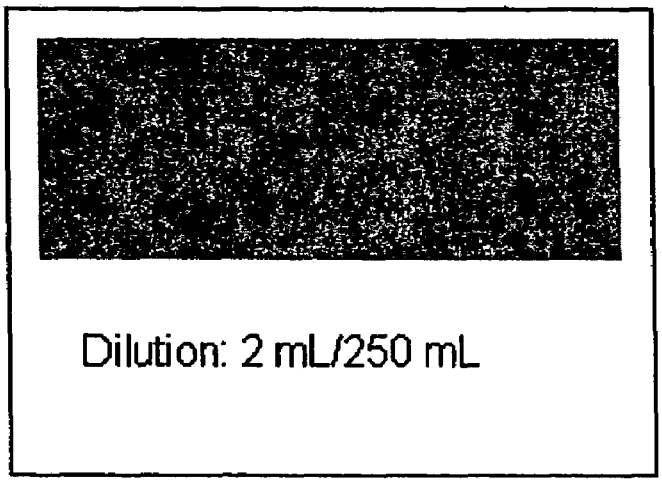

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

The general procedure for treating damaged color textiles includes several steps. Preferably, but not necessary, the damaged area may be rinsed with hot water to extract any excess or remaining bleach, or similar chemicals. Next, the area may optionally be treated with a bleach neutralizing solution containing a reducing agent to neutralize any bleach left in the fibers of the textile. A clothes iron, a wallpaper steamer, or other source of steam or heat should be used to catalyze the neutralization reaction of the damaged area. Also, the area may optionally be treated with a surfactant to reduce the surface tension of the fibers so that a later application of dye will penetrate to all necessary areas. Finally, the damaged area may optionally be treated with a dye preparation solution containing a weak acid to prepare the fibers to bond more effectively with the dyes. Between each step it is recommended to extract, potentially using a vacuum, any excess chemicals or agents.

After preparing the damaged area, the material is ready to be dyed. In one embodiment, using a color loss filter, or a long-pass filter that only transmits light at certain wavelengths, a user can view the damaged area of the textile and determine the color loss. For example, for blue loss, the applicator would view the damaged area with a blue loss filter. For red loss and yellow loss, the applicator would view the damaged area with a red loss and yellow loss filter respectively. If the damaged area is visible through the blue loss filter it is an indication that there is a blue color loss. To repair the blue color loss, the damaged area is treated with a working blue dye solution and the excess is extracted.

Concentrated dye solutions are created by mixing a dye solution with a fixed amount of water. Concentrated dye solution compositions vary according to the color of the dye (blue, red, or yellow). In this particular embodiment the concentrated blue dye solution is composed of between 0.00016 to 0.0016 grams of blue dye per approximately 100 milliliters of water. The concentrated red dye solution is composed of between 0.0002 to 0.002 grams of red dye per approximately 100 milliliters of water. The concentrated yellow dye solution is composed of between 0.00008 to 0.0008 grams of yellow dye per approximately 100 milliliters of water. Typically, these concentrated dye solutions are provided to the applicator to create working dye solutions.

Working dye solutions are the solutions that are mixed by the applicator to be used in repairing the damaged area of the textile. Working dye solutions are created by mixing the concentrated dye solution with a fixed amount of water. For lightly colored carpets, i.e. beige, tan, yellow, the applicator creates the working dye solution by diluting the concentrated dye solutions to approximately 2 milliliters of concentrated dye solution per approximately 500 milliliters of water. For medium colored carpets, i.e. brown, pink, orange, the concentrated dye solution should be diluted to approximately 10 milliliters of dye per approximately 500 milliliters of water. Finally, for dark colored carpets, i.e., blue, green, gray, the concentrated dye solutions should be diluted to approximately 20 milliliters of dye per approximately 500 milliliters of water.

Once the working dye solutions are mixed, the dye application process is ready to begin. In a preferred embodiment, while viewing the damaged area through the blue loss filter, or a long-pass filter that transmits light of wavelengths longer than approximately 550 nanometers, the applicator applies the working blue dye solution to the damaged area repeatedly until the damaged area is invisible through the blue loss filter. The excess dye is extracted, preferably with a vacuum or dry cloth. If, after five or so applications and extractions, no change occurs, or only a slight change occurs, increase the concentration of the working dye solution by adding 1 milliliter of the concentrated dye solution and repeat the process. When the damaged area is invisible through the blue loss filter, the undamaged area and damaged area comprise substantially the same amount of blue dye. It is noted, because the damaged area is still red and yellow dye deficient, the damaged area may still be visible to the naked eye.

In one embodiment, following the blue dye application, the applicator next uses a red loss filter, or a band-pass filter that transmits only light of wavelengths between approximately 450 nanometers and approximately 550 nanometers, to indicate red loss in the damaged area. Similar to the application of the blue dye process, the applicator views the damaged area through the red loss filter and applies the working red dye solution to the damaged area. Again, after each application, the excess red dye is removed. The application and excess dye solution removal is repeated until the damaged area is no longer visible through the red loss filter. Again, it is noted that he damaged area is still visible to the naked eye as the undamaged area is still yellow dye deficient.

In one embodiment, following the blue dye and red dye application, the applicator uses a yellow loss filter, or a short-pass filter that transmits light of wavelengths shorter than approximately 450 nanometers, to determine yellow loss in the damaged are. When looking at the damaged area through the yellow loss filter, if a damaged area is still visible, it is an indication that there is yellow loss in the damaged area. Thus, while viewing the damaged area through the yellow loss filter the applicator repeatedly applies and extracts the working yellow dye solution to the damaged area until the damaged area is invisible through the yellow loss filter.

When the blue, red, and yellow working dyes have all been applied until the damaged area is invisible according the respective color loss filters, the damaged area should visually match the undamaged area.

FIG. 1 illustrates one embodiment of typical gray scale comparator cards to determine the proper working dye solution. In this additional embodiment, the gray scale system consists of ten cards indicating working solutions of 1 milliliter per 250 milliliters to 10 milliliters per 250 milliliters in 1 milliliter increments. The applicator begins by placing a white material on an undamaged area of the carpet to be dyed and looks through any of the color loss filters. If a damaged area is visible, it is an indication that there is color loss in the damaged area. While looking through the selected color loss filter, the applicator compares the contrast between the white material and the undamaged area with the contrast between the shaded and unshaded portions of the gray scale comparator card. The corresponding gray scale comparator card indicates a dilution level for dying the damaged area. As an example, for blue color loss, the applicator views the white material, the undamaged area and the comparator cards through the blue loss filter. The contrast between the white material and the undamaged area is compared to the gray scale comparator cards. When a match is found between the contrast of the undamaged area and the white material and the contrast on the gray scale comparator card, the dilution level shown on the card indicates the working dye solution composition. The same process is repeated to prepare the working dye solutions for the red and yellow dyes.

The working blue, red, and yellow dye solutions are applied while viewing the damaged area through the respective color loss filters, as described previously. The process may need to be repeated until the damaged area is invisible through the color loss filters.

To set the dyes and make them less prone to re-bleaching or fading due to residual bleaching agents, the applicator should heat the area with a clothes iron, a wallpaper steamer, or other source of steam or heat.

It is understood that the above-described arrangements are only illustrative of the application of the principles of the present invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, variations in the design of filters are envisioned. The filters may be designed in the shape of glasses, or safety goggles, to be worn by the applicator during use. Alternatively, the filters may be designed in the shape of a screen attached to a hat or helmet, similar to the design and shape of a welder's face shield or a dental hygienist's facial screen.

Although the mentioned embodiments discuss the user of ten gray scale cards, it is anticipated that any number of cards and gray scale hues may be utilized. This will enable a use to have more refined selection of dye mixing concentrations. Additionally, although cards are discussed to be used, any means of providing a visual view of the various gray scale shades will work. For example, a gray scale color wheel, chart, linear scale, or even an electronic color meter may work.

Furthermore, although the matching dye mixing dilution formulas are placed on the gray scale cards, any form of associating the matching formulas is contemplated. For example, just the dye amount may be associated therewith provided that a set amount of water is known to be mixed therewith. Additionally, the comparator gray cards may be individualized according to the respective filter, or they may be combined into one card with varying dilution rates for each color loss filter.

Finally, although gray scale is discussed as the comparative hue, other known colors may be used, like blues, reds, blacks, whites, etc. Also, although it is discussed to have a preferred gray scale card that calculates dilutions from 1 milliliter of dye per 250 milliliters of water, any amount of dilution variations are anticipated. For example, any amount of water may be used instead of a standard 250 milliliter, or any corresponding amount of dye may be mixed. All of the variations are known to one skilled in the art of mixing concentrations and dilutions, and are contemplated in this invention.

The general sequence of steps within the process may be performed in any order and/or combination to achieve the desired result. For example, any filter and dye may be employed at any time to alter the color of the affected area. Also, the entire process may be repeated as many times as is necessary to achieve an acceptable color match.

Thus, while the present invention has been fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A method for spot-dyeing a damaged area on a textile, comprising the steps of:

inspecting the damaged area through a primary color loss filter;

determining whether a primary color is missing from the damaged area by being able to view the damaged area through the primary color loss filter to, thereby, confirm that the primary color is missing from the damaged area;

placing a white material on an undamaged area of a textile to be dyed;

viewing through the color loss filter the white material and the undamaged area of a textile;

matching a contrast between the white material and the undamaged area of a textile with a gray scale;

preparing at least one working dye solution according to a dilution rate corresponding to the match on the gray scale; and applying at least one of a primary color dye, corresponding to the selected color loss filter, to the damaged area, while viewing the damaged area through the color loss filter, until the damaged area is substantially invisible through the color loss filter.

2. The method of claim 1, before the inspecting step, further comprising the steps of:

rinsing the damaged area with a rinse solution;

extracting the excess rinse solution; and treating the damaged area with a bleach neutralizing solution.

3. The method of claim 1, wherein the damaged area is inspected through a blue loss filter, and wherein the primary color applied to the damaged area is blue; and after the applying step, further comprising the step of removing the excess blue dye.

4. The method of claim 1, wherein the damaged area is inspected through a red loss filter, and wherein the primary color applied to the damaged area is red; and after the applying step, further comprising the step of removing the excess red dye.

5. The method of claim 1, wherein the damaged area is inspected through a yellow loss filter, and wherein the primary color applied to the damaged area is yellow; and after the applying step, further comprising the step of removing the excess yellow dye.

6. The method of claim 1, wherein the determining step uses the selected color loss filter to view the damaged area, and determines whether the damaged area lacks a primary color is if the damaged area is visible through the selected color loss filter.

7. The method of claim 1, after the determining step, further comprising the step of preparing a working dye solution by diluting a concentrated dye solution with water.

8. The method of claim 7, wherein the concentrated blue dye solution contains about 0.00016 to 0.0016 grams of dye per 100 milliliters of water, the working red dye solution contains about 0.0002 to 0.002 grams of dye per 100 milliliters of water, and the yellow dye solution contains about 0.00008 to 0.0008 grams of dye per 100 milliliters of water.

9. The method of claim 8, wherein the applying step further includes the step of applying a working dye solution containing approximately 1 milliliter of concentrated dye per 250 milliliters of water for light carpets, approximately 5 milliliters of concentrated dye per 250 milliliters of water for medium colored carpets, and approximately 10 milliliters of concentrated dye per 250 milliliters of water for dark colored carpets.

10. The method of claim 1, wherein the viewing, matching, and preparing steps are repeated for each primary color.

11. The method of claim 1, wherein the color loss filters are mounted in eye glasses.

12. A method for spot-dyeing a damaged area on a textile, comprising the steps of:

inspecting the damaged area through a selected color loss filter that filters according to a primary color;

determining whether the primary color is missing from the damaged area by being able to view the damaged area through the selected color loss filter to, thereby, confirm that the primary color is missing from the damaged area;

placing a white material on an undamaged area of a textile to be dyed;

viewing through the color loss filter the white material and the undamaged area of a textile;

matching a contrast between the white material and the undamaged area of a textile with a gray scale;

preparing at least one working dye solution according to a dilution rate corresponding to the match on the gray scale; and applying at least one of a primary color dye, corresponding to the selected color loss filter, to the damaged area, while viewing the damaged area through the color loss filter, until the damaged area is substantially invisible through the color loss filter.

13. The method of claim 12, further comprising the step of repeating the steps of inspecting, determining, placing, viewing, matching, preparing, and applying for a second primary color and for a third primary color.

* * * * *